US006193523B1

(12) United States Patent
Harper, Jr.

(10) Patent No.: US 6,193,523 B1
(45) Date of Patent: Feb. 27, 2001

(54) CONTACT FOR ELECTRICAL CONNECTOR

(75) Inventor: Donald K. Harper, Jr., Harrisburg, PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/302,000

(22) Filed: Apr. 29, 1999

(51) Int. Cl.[7] ..... H01R 12/00
(52) U.S. Cl. ..... 439/66; 439/83; 439/874
(58) Field of Search ..... 439/62, 83, 874, 439/876, 866, 867, 868

(56) References Cited

U.S. PATENT DOCUMENTS

| | | | | |
|---|---|---|---|---|
| Re. 34,084 | * | 9/1992 | Noschese | 439/66 |
| 5,152,695 | * | 10/1992 | Grabbe et al. | 439/66 |
| 5,167,512 | * | 12/1992 | Walkup | 439/66 |
| 5,199,889 | * | 4/1993 | McDevitt, Jr. | 439/66 |
| 5,308,210 | | 5/1994 | Grabbe et al. | 439/66 |
| 5,366,380 | * | 11/1994 | Reymond | 439/66 |
| 5,378,160 | * | 1/1995 | Yumibe et al. | 439/66 |
| 5,632,631 | | 5/1997 | Fjelstad et al. | 439/82 |
| 5,746,626 | * | 5/1998 | Kwiat et al. | 439/83 |
| 5,772,449 | * | 6/1998 | Feldmeier et al. | 439/66 |
| 5,772,451 | | 6/1998 | Dozier et al. | 439/70 |
| 5,800,184 | | 9/1998 | Lopergolo et al. | 439/66 |
| 5,810,609 | | 9/1998 | Faraci et al. | 439/71 |
| 5,812,378 | | 9/1998 | Fjelstad et al. | 361/769 |
| 5,967,797 | * | 10/1999 | Maldonado | 439/83 |

FOREIGN PATENT DOCUMENTS

WO 98/15989 4/1998 (WO) .

* cited by examiner

*Primary Examiner*—T. C. Patel
(74) *Attorney, Agent, or Firm*—M. Richard Page; Brian J. Hamilla

(57) ABSTRACT

A contact for use in an electrical connector that interconnects a first circuit substrate and a second circuit substrate. The contact can have an intermediate portion; a mounting portion extending from the intermediate portion for securing the contact to the first circuit substrate; and a mating portion extending from the intermediate portion and adapted to provide a non-linear wiping action to the second circuit substrate upon deflection of the mating portion by the second circuit substrate. The contact may be formed from a sheet of material and comprises: a mounting portion for mounting the connector to a first circuit substrate; and a mating portion for engaging a second circuit substrate. The mating portion has an edge that engages the second circuit substrate. The contact could be formed by: providing a sheet of conductive material; stamping a shape from said material, the shape including: an intermediate portion having a medial section and opposed ends; a mounting portion extending from the intermediate portion; and an arch-shaped mating portion extending from the intermediate portion and having an edge; and bending the opposed ends at an angle relative to said medial section. The edge of the mating portion is adapted to engage a circuit substrate.

23 Claims, 6 Drawing Sheets

CONTACT FOR ELECTRICAL CONNECTOR

BACKGROUND OF THE INVENTION

1. Field of the Invention

The present invention relates to a contact for an electrical connector. More specifically, the present invention relates to a compressive contact in an electrical connector that engages a pad on a circuit substrate.

2. Brief Description of Earlier Developments

Generally speaking, each new generation of an electronic product involves a miniaturization of the previous generation. Mobile telephones provide an excellent example. The size of each new generation of mobile telephones has consistently decreased from the previous generation of mobile telephones.

Miniaturization reduces the space available for the electronic components used in the product. While undoubtedly affecting electronic component design, the reduced size of the electronic components in the product also affects the design of the connectors used in the product. One design consideration as a result of miniaturization occurs in the X-Y plane of the connector. Miniaturization may require that the same number of contacts engage a smaller electronic component. In other words, the number of contacts per unit area of the connector, also known as contact density, must increase.

Another design consideration as a result of miniaturization occurs along the Z-axis of the connector. Miniaturization may limit the height of the connector. In a board-to-board interconnect, for example, product size may determine the maximum allowable spacing between boards. The interconnect must fit in the space between the boards.

Current electrical connector designs, while suitable for current generations of electronic products, may not be suitable for subsequent generations of electronic products. Thus, a need exists for electrical connectors capable of use in next generation electronic products.

SUMMARY OF THE INVENTION

It is an object of the present invention to provide an improved contact for use in an electrical connector.

It is a further object of the present invention to provide a contact having a non-linear wiping action.

It is a further object of the present invention to provide a compressive contact It is a further object of the present invention to provide a low profile height electrical connector.

It is a further object of the present invention to provide an electrical connector that is inexpensive to manufacture.

It is a further object of the present invention to provide a surface mounted board-to-board electrical connector.

It is a further object of the present invention to provide a low profile BGA connector.

These and other objects of the present invention are achieved in one aspect of the present invention by a contact for use in an electrical connector that interconnects a first circuit substrate and a second circuit substrate. The contact has an intermediate portion; a mounting portion extending from the intermediate portion for securing the contact to the first circuit substrate; and a mating portion extending from the intermediate portion and adapted to provide a non-linear wiping action to the second circuit substrate upon deflection of the mating portion by the second circuit substrate.

These and other objects of the present invention are achieved in another aspect of the present invention by a contact used in an electrical connector, formed from a sheet of material and comprising: a mounting portion for mounting the connector to a first circuit substrate; and a mating portion for engaging a second circuit substrate. The mating portion has an edge that engages the second circuit substrate.

These and other objects of the present invention are achieved in another aspect of the present invention by an electrical connector that interconnects a first circuit substrate and a second circuit substrate. The connector comprises: an insulative housing; and a contact. The contact has a intermediate portion located in the housing; a mounting portion extending from the intermediate portion for securing the connector to the first circuit substrate; and a mating portion extending from the intermediate portion and adapted to provide an arcuate wiping action to the second circuit substrate upon deflection of the mating portion by the second circuit substrate.

These and other objects of the present invention are achieved in another aspect of the present invention by a method of making a contact, comprising the steps of: providing a sheet of conductive material; stamping a shape from the material, the shape including: an intermediate portion having a medial section and opposed ends; a mounting portion extending from the intermediate portion; and an arch-shaped mating portion extending from the intermediate portion and having an edge; and bending the opposed ends at an angle relative to the medial section. The edge of the mating portion is adapted to engage a circuit substrate.

BRIEF DESCRIPTION OF THE DRAWINGS

Other uses and advantages of the present invention will become apparent to those skilled in the art upon reference to the specification and the drawings, in which.

DETAILED DESCRIPTION OF THE PREFERRED EMBODIMENTS

The present invention connects two electronic componets such as two circuit substrates. FIGS. 1, 2*a*, 2*b*, 3*a*, 3*b*, 4*a*, 4*b* and 6 demonstrate a first alternative embodiment. FIGS. 1, 4*a*, 4*b*, 5*a*, 5*b* and 6 demonstrate a second alternative embodiment. Each embodiment will be described individually below.

Figure 1:
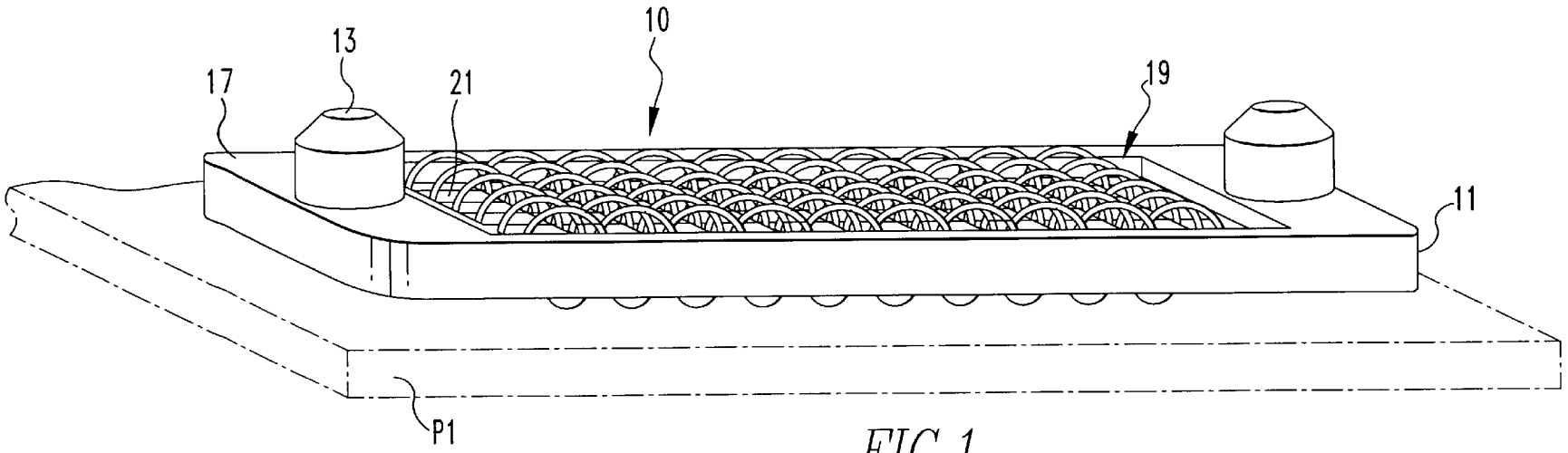
FIG. 1 is a perspective view of a connector utilizing a contact of the present invention.

As seen in FIG. 1, an electrical connector 10 mounts to a first circuit substrate, such as a printed circuit board (PCB) P1. PCB P1 can be made from a suitable material, such as FR4. PCB P1 includes conductive traces (not shown) thereon.

Connecter 10 has an insulative housing 11 made from a suitable dielectric material, such as liquid crystal polymer (LCP). Housing 11 can have a plurality of alignment post 13 extending therefrom. Alignment posts 13 engage corresponding apertures (not shown) in a second circuit substrate, such as PCB P2 (shown in phantom in FIG. 4*a*). Once alignment posts 13 enter the corresponding apertures during mating, contacts 15 are properly positioned relative to a pad, or land L, on PCB P2. Contacts 15 also secure, at their opposite end, to the traces on PCB P1.

Housing 11 has a mating face 17 against which PCB P2 abuts during mating. Suitable retention features (not shown) maintain PCBs P1, P2 together and PCB P2 against connector 10. Typically, these retention features are separate from connector 10. Thus, only a brief description is warranted. Alternatively, however, connector 10 could include, for example, latches or fasteners (not shown) to secure PCB P2 against connector 10.

Housing 11 has a recessed area 19. Within recessed area 19, a plurality of apertures 21 extend through housing 11. Contacts 15 reside within apertures 21. Apertures 21 generally correspond to the shape of the portion of contacts 15 residing within housing 11. When viewed in cross-section, the lower portion of aperture 21 adjacent PCB P1 generally conforms to the shape of the planar mounting portion of contact 15. In addition, the upper portion of aperture 21 adjacent recessed area 19 generally conforms to the larger and arcuate shaped intermediate portion of contact 15.

Preferably, contacts 15 are stitched into housing 11 using a known insertion machine. Since the intermediate and mating portions of contact 15 are larger than the mounting portion, insertion of contacts 15 preferably occurs from mating face 17 (i.e. the side of housing 11 having recessed area 19) towards the side of housing 11 facing PCB P1. This serves to "lock" contacts 15 within housing 11 after contacts 15 secure to PCB P1. However, the present invention could also use an overmold process to form housing 11 around contacts 15.

Contacts 15 are located within recessed area 19 to control the amount of deflection allowed during mating of connector 10 with PCB P2. Typically, recessed area 19 prevents permanent deformation of contacts 15 by PCB P2. This feature will be described in more detail below. Contacts are preferably made of a suitable conductive material, such as phosphor bronze or beryllium copper, with appropriate plating.

Figure 2A:
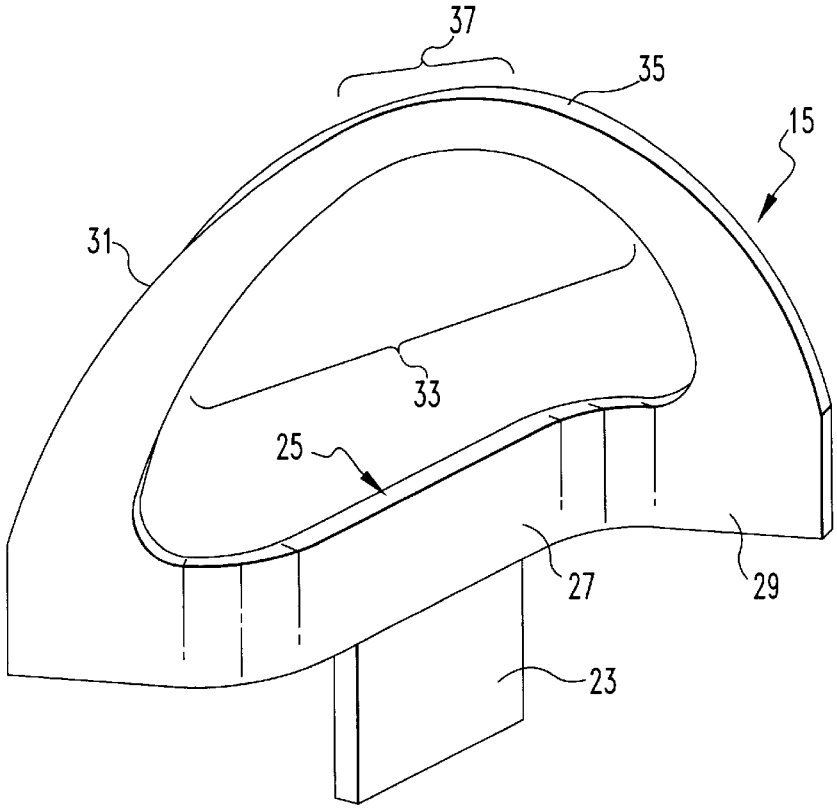
FIG. 2*a* is a perspective view of one alternative embodiment of a contact of the present invention.
Figure 2B:
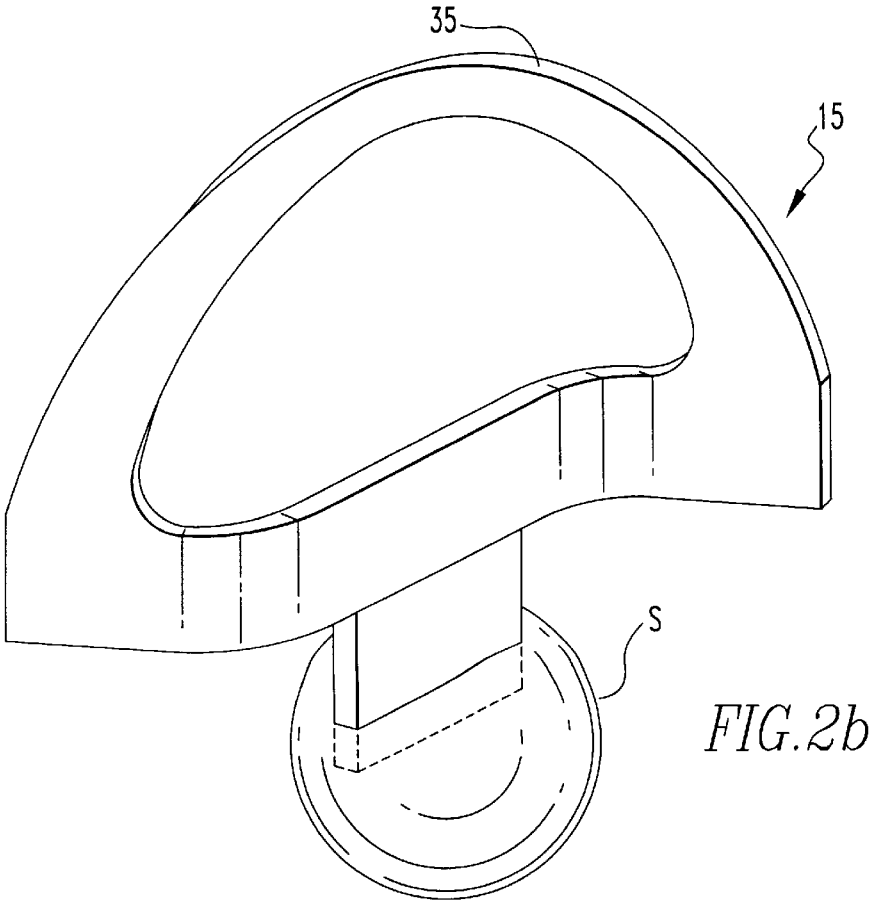
FIG. 2*b* is a perspective view of the contact in FIG. 2*a* associated with a solder ball.

FIG. 2*a* provides a detailed view of the first alternative embodiment of contact 15 in an unloaded condition. Contact 15 has a mounting portion 23 used to mount connector 10 to PCB P1. FIG. 2*b* shows mounting portion 23 receiving a fusible element, such as a mass of solder S. Preferably, solder mass S is a solder ball. By utilizing solder mass S, connector 10 can surface mount to PCB P1 using reflow methods, including ball grid array (BGA) technology. International Publication number WO 98/15989 (International Application number PCT/US97/18066), herein incorporated by reference, describes methods of securing a solder ball to a contact and of securing a BGA connector to a substrate.

While FIG. 2*b* demonstrates one specific method of securing connector 10 to PCB P1, Applicant recognizes that the present invention could use other types of terminations, such as press-fit, surface mount and through hole.

Figure 4A:
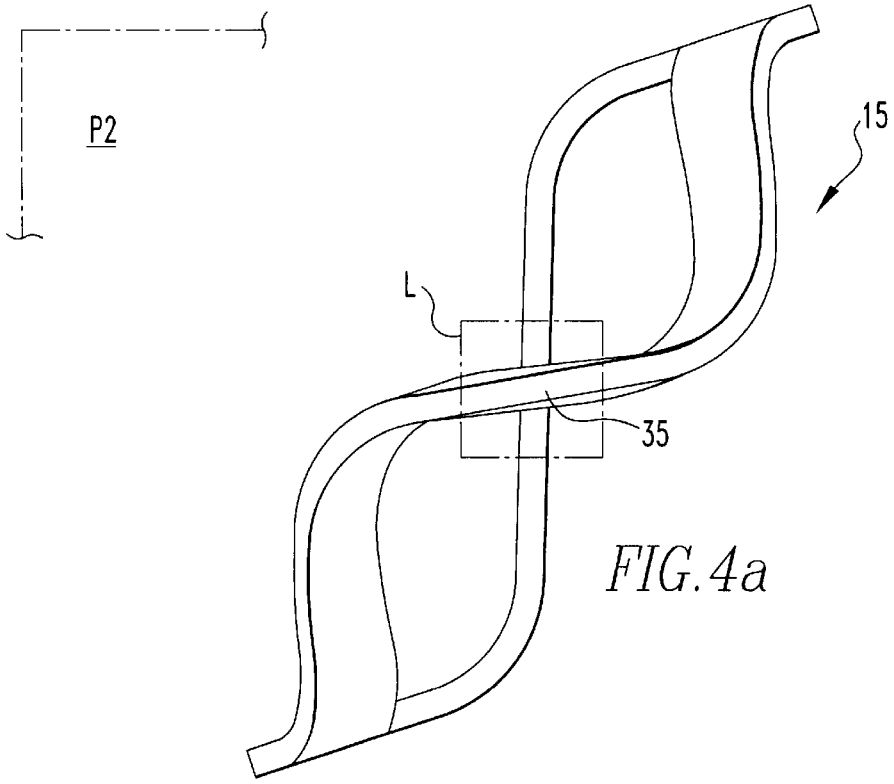
FIG. 4*a* is a top view of the contact in FIG. 2*a* in an unloaded, or non-deformed, condition.

Mounting portion 23 extends from an intermediate portion 25 of contact 15. Intermediate portion 25 seats within housing 11, specifically residing in correspondingly shaped aperture 17. Intermediate portion 25 can have a generally planar medial section 27 flanked by curved sections 29. Curved sections 29 can extend generally transverse to medial section 27 and preferably extend from medial section 27 in opposite directions. As seen in FIG. 4*a*, intermediate portion 25 is generally S-shaped.

A mating portion 31 also extends from intermediate portion 25. Preferably, mating portion 31 extends from an opposite end of intermediate portion 25 than mounting portion 23. As seen in FIG. 2*a*, mating portion 31 has an arcuate shape and extends in an arched fashion between opposed curved sections 29. Mating portion 31 has a twisted middle section 33. Twisted middle section 33 allows a minor surface 35 of mating portion 31 to face PCB P2 and to make contact with land L. The arrangement of twisted middle section 33 provides a generally planar area 37 along minor surface 35 with which to support land L of PCB P2. Planar area 37 continues to abut land L of PCB P2 even during deflection of contact 15.

The interaction between land L and minor surface 35 (when compared to a major surface of middle section 33) provides a more rigid support to PCB P2. The orientation helps contact 10 provide a suitable normal force to PCB P2.

Figure 3A:
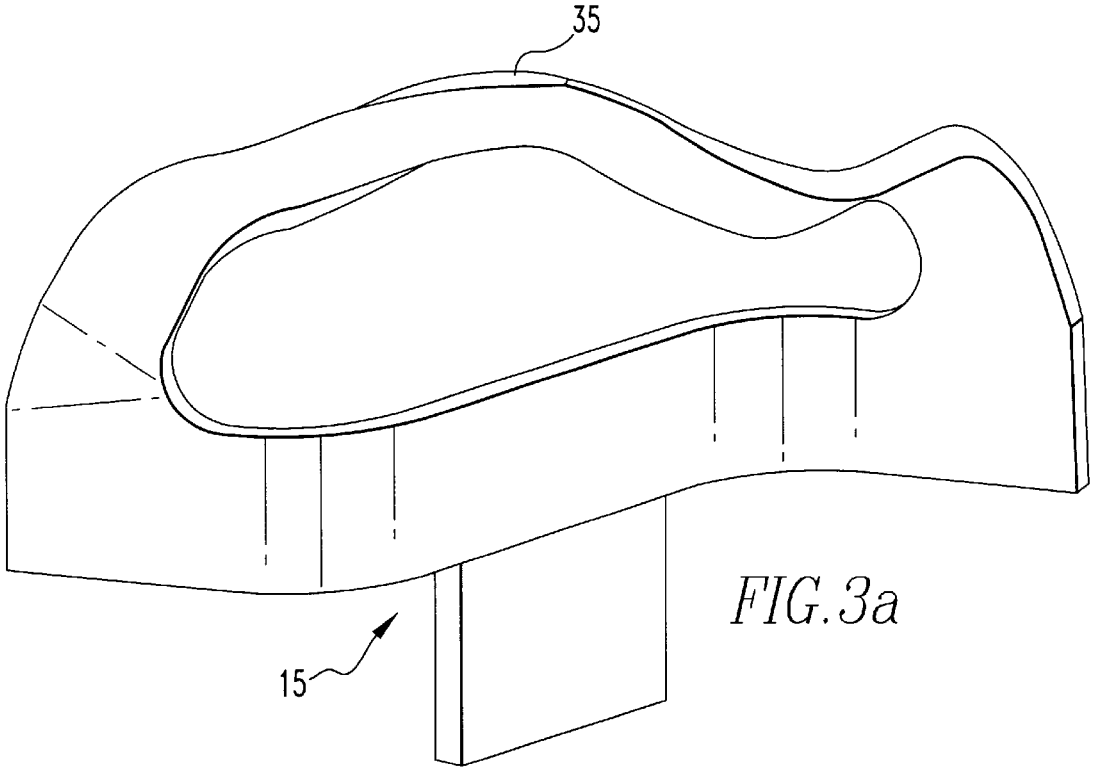
FIG. 3*a* is a perspective view of the contact in FIG. 2*a* in an unloaded, or non-deformed, condition.

Twisted middle section 33 also assists in the deflection of mating portion 31 by PCB P2 during mating. FIGS. 3a and 4a display contact 15 at rest, prior to engaging land L of PCB 2. Minor surface 35 of contact 15 will engage receive land L of PCB P2 as PCB P2 approaches PCB P1. As land L bears against minor surface 35, contact 15 begins to deflect.

Figure 3B:
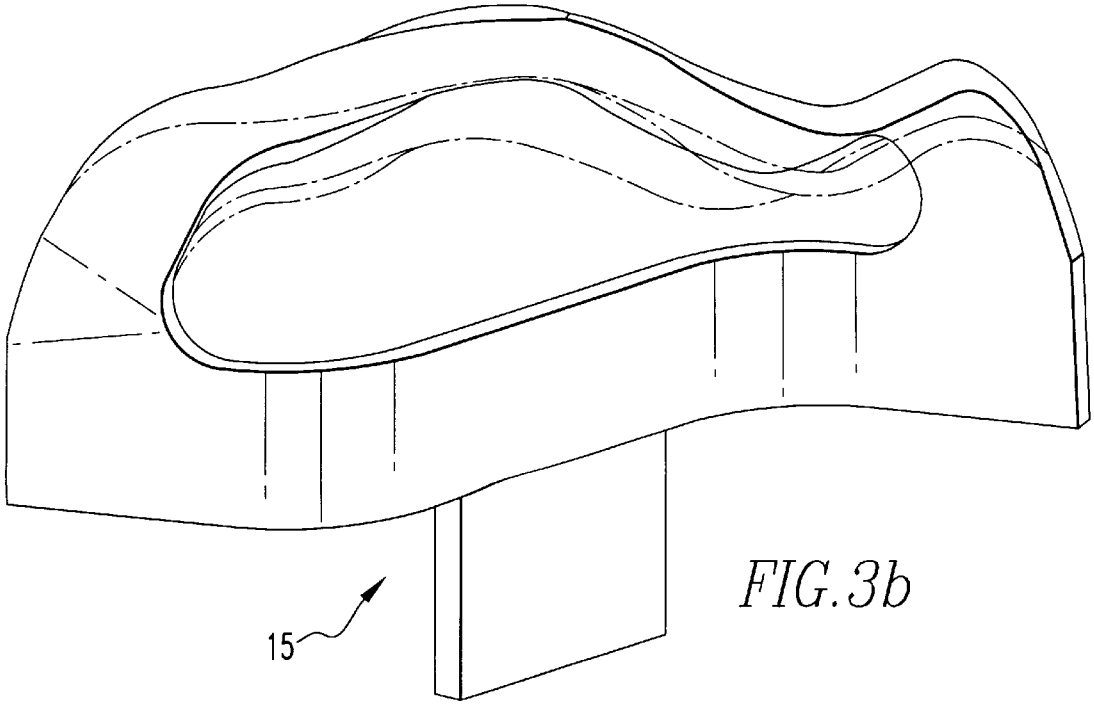
FIG. 3*b* is a perspective view of the contact in FIG. 3*a* in an unloaded condition (using solid lines) and a loaded, or deformed, condition (using phantom lines)
Figure 4B:
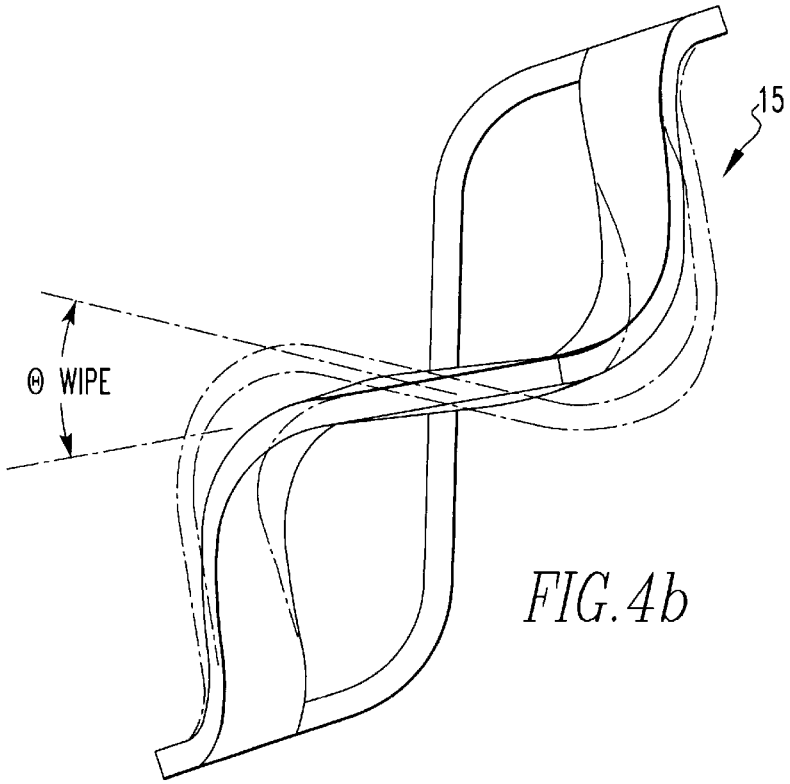
FIG. 4*b* is a top view of the contact in FIG. 4*a* in an unloaded condition (using solid lines) and a loaded, or deformed, condition (using phantom lines)

FIGS. 3*b* and 4*b* display contact 15 in a loaded, or deflected, condition after PCB P2 seats against mating face 17 of housing 11 of connector 10. As clearly shown in FIG. 3*b*, contact 15 compresses, or decreases in height. Even during compression, minor surface 35 of contact 15 remains against land L of PCB P2. In other words, planar area 37 maintains the same longitudinal orientation relative to land L of PCB P2 during continued compression of contact 15. Compression of contact 15, however, deflects the portions of mating portion 31 adjacent curved sections 29. The resiliency of mating portion 31 provides a suitable normal force against PCB P2.

In addition to providing a suitable normal force, mating portion 31 also provides a suitable wiping action against land L of PCB P2. Mating portion 31 provides a complex wiping action to land L of PCB P2 during deflection. Preferably, minor surface 35 provides a wiping action that is, at least in part, non-linear. As seen in FIG. 4*b*, minor surface 35 preferably rotates relative to land L of PCB P2. Stated differently, mating portion 31 torsionally wipes land L of PCB P2 through an angle $\Theta_{wipe}$. Preferably, mating portion 31 torsionally wipes land L of PCB P2 through an angle of between approximately 5 to 15°.

The amount of compression of contact 15 by PCB P2 determines the amount of angular wipe produced by mating portion 31. As discussed earlier, recessed area 19 helps control the amount of compression of contacts 15. Preferably, contacts 15 are compressed without deformation. Avoiding deformation maintains the resiliency of contacts 15. The distance that contacts 15 extend above mating face 17 is the amount of compression allowed by connector 10. Clearly, therefore, the extent of recessed area 19 determines the amount of deflection of contacts 15 by PCB P2.

Figure 5A:
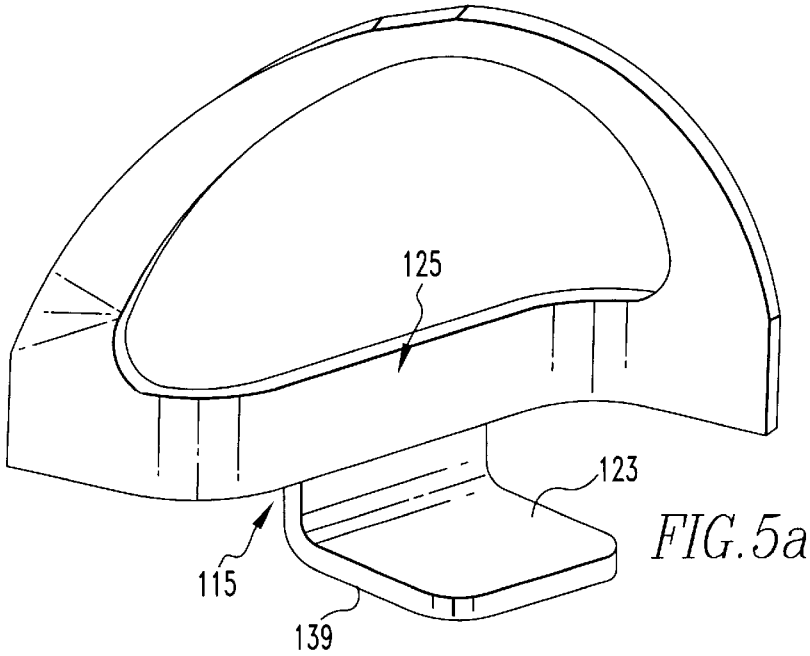
FIG. 5*a* is a perspective view of another alternative embodiment of a contact of the present invention.
Figure 5B:
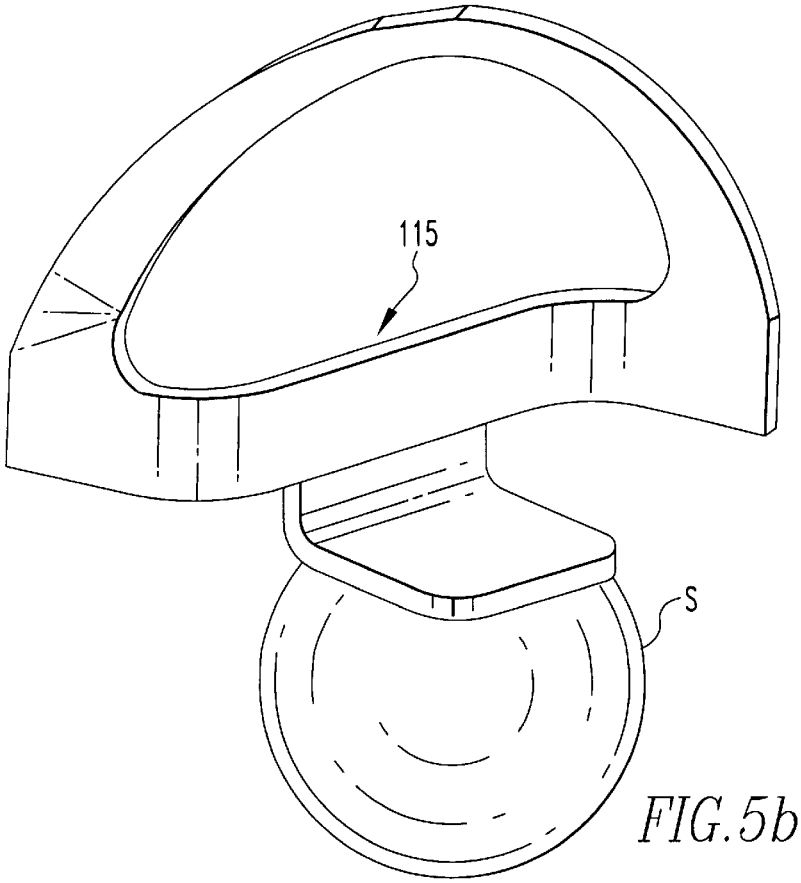
FIG. 5*b* is a perspective view of the contact of FIG. 5*a* associated with a solder ball.
Figure 6:
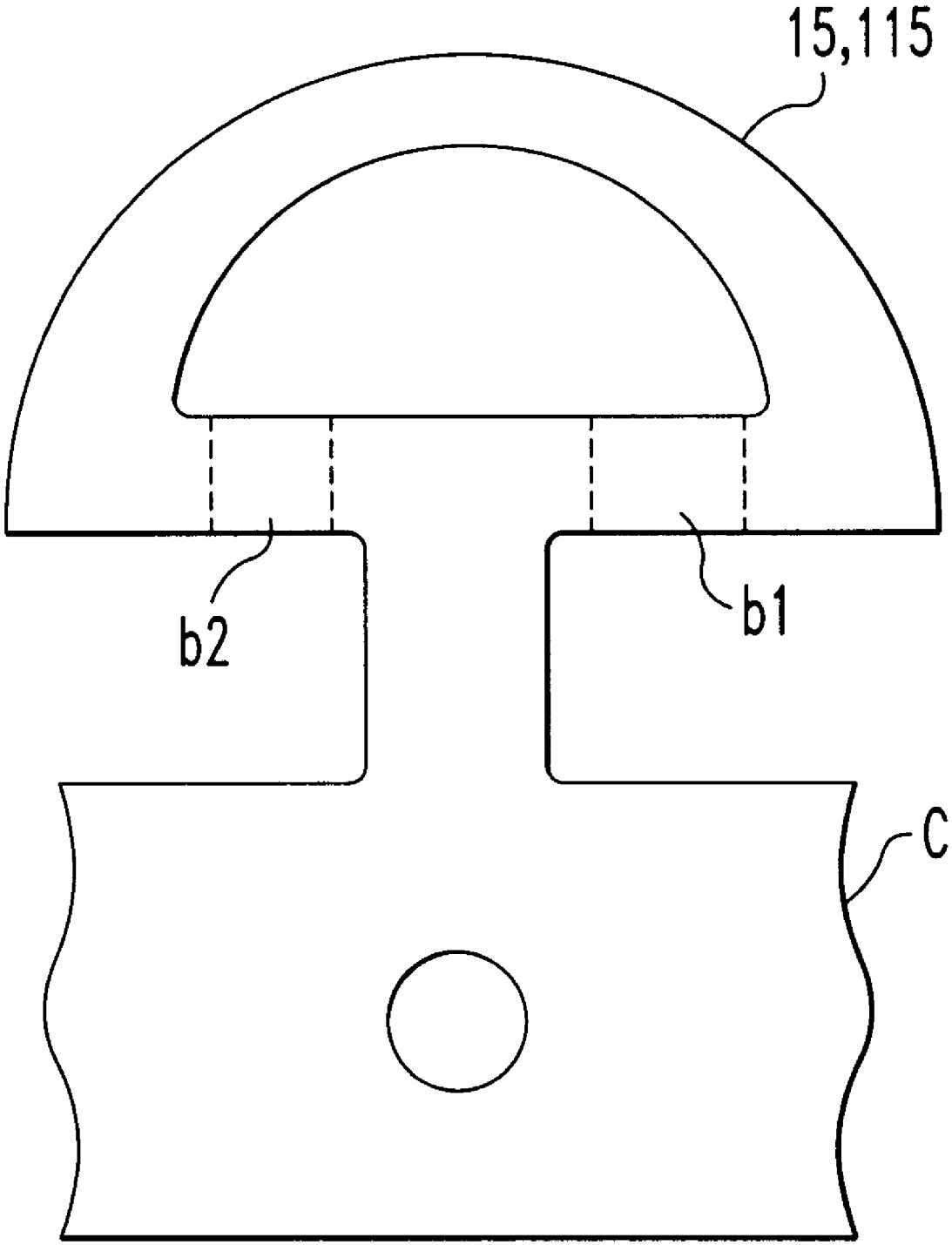
FIG. 6 is a side view of a contact of the present invention on a carrier strip prior to the forming process.

FIG. 5*a* and 5*b* provide the second alternative embodiment of the present invention. Aside from one feature, contact 115 is generally identical to contact 15 in FIGS. 2*a* and 2*b*. In order to avoid repetition, only the differences between contact 115 and contact 15 will be discussed. Rather than extending generally parallel as in the first alternative embodiment, mounting portion 123 extends at an angle from intermediate portion 125. Preferably, mounting portion 123 extends transversely to intermediate portion 125. FIG. 5*a* shows mounting portion 123 extending generally perpendicular to intermediate portion 125. Preferably, bending of mounting portion 123 occurs after insertion of contact 115 into the connector housing. However, contact 115 could have a pre-bent mounting portion 123.

Mounting portion 123 has a side surface 139 that faces PCB P1. As shown in FIG. 5*b*, a fusible element S secures to side surface 139. As with the first alternative embodiment, fusible element S could be a mass of solder S. However, Applicant recognizes that the present invention could use other types of terminations.

In the preferred embodiment, contacts 15, 115 are stamped and formed. The stamping and forming operation forms contacts 15, 115 from a carrier strip C using known techniques. The forming step bends contacts 15, 115 at locations b1, b2. Bends at locations b1, b2 provide the arcuate shape to intermediate portion 25.

As discussed above, minor surfaces 35 of contacts 15, 115 engage lands L of PCB P2. During conventional stamping and forming, the minor surfaces 35 and the edges between minor surfaces and the major surfaces may be sharp or uneven. Preferably, therefore, the present invention performs a step in addition to the aforementioned stamping and forming. The additional step treats minor surfaces 35 and/or the edges between minor surfaces 35 and the major surfaces. As one example, minor surfaces 35 could be shaved. The conventional shaving process removes sharp edges or burrs created during stamping. Other treatments, such as coining or filing, could be used. This treatment step provides a smooth interface between contacts 15 and lands L on PCB P2.

Once contact 15, 115 seats within aperture 17 in housing 11, the interaction between intermediate portion 25 and aperture 17 prevents any torsional stresses that occur during mating from acting on the solder joint between mounting portion 23 and PCB P2. This helps ensure the quality of the solder joint through repeated mating cycles.

The present invention reduces the amount of space required by a connector located between two adjacent PCBs. In particular, the present invention demands less space between PCBs since the present invention utilizes only one connector housing. Conventional mezzanine connectors use two mateable housings.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A contact usable in an electrical connector interconnecting a first electronic component and a second electronic component, comprising:

an intermediate portion;

a mounting portion extending from said intermediate portion for securing the contact to the first electronic component; and a mating portion extending from said intermediate portion and adapted to provide a wiping action to the second electronic component, the mating portion having two opposite spaced ends separately connected to the intermediate portion, the wiping action comprising a non-linear wipe path on a surface of the second electronic component upon deflection of said mating portion by the second electronic component.

2. The contact as recited in claim 1, wherein said intermediate portion has an arcuate shape.

3. The contact as recited in claim 1, wherein said intermediate portion comprises a medial portion generally residing in a plane and flanked by arcuate sections.

4. The contact as recited in claim 3, wherein said arcuate sections extend in opposite directions from said plane of said medial portion.

5. The contact as recited in claim 1, wherein said mating portion is a compressible member.

6. The contact as recited in claim 5, wherein said mating portion has an arcuate shape.

7. The contact as recited in claim 6, wherein said mating portion includes a twisted section.

8. The contact as recited in claim 1, wherein said mounting portion extends transversely to said intermediate portion.

9. The contact as recited in claim 1, wherein said mating portion extends generally transverse to said intermediate portion.

10. The contact as recited in claim 1, wherein said non-linear wiping action is rotational.

11. The contact as recited in claim 1, wherein a minor surface of said mating portion engages the second substrate.

12. A contact, used in an electrical connector, formed from a sheet of material and comprising:

a mounting portion for mounting the connector to a first electronic component; and a mating portion for engaging a second electronic component, said mating portion having a narrow side edge substantially formed by a thickness of the sheet of material that engages the second electronic component, wherein said mating portion is an arch with a top of the arch being located for contacting the second electronic component.

13. The contact as recited in claim 12, wherein said arch has a twisted section.

14. An electrical connector interconnecting a first electronic component and a second electronic component, comprising:

an insulative housing; and a contact, comprising:

an intermediate portion located in said housing;

a mounting portion extending from said intermediate portion for securing the connector to the first electronic component; and a mating portion extending from said intermediate portion and adapted to provide a wiping action to the second electronic component upon deflection of said mating portion by the second electronic component, wherein the mating portion comprises two spaced ends connected to the intermediate portion, and wherein a wipe path along a surface of the second electronic component has an arced shape.

15. The electrical connector as recited in claim 14, further comprising a fusible element secured to said mounting portion for surface mounting the connector to the first electronic component.

16. The electrical connector as recited in claim 15, wherein said fusible element is a solder ball fused to said mounting portion for subsequent surface mounting to the first electronic component.

17. The electrical connector as recited in claim 14, wherein said housing includes structure to prevent movement of said contact within said housing during mating.

18. The electrical connector as recited in claim 14, wherein said structure includes an aperture in said housing corresponding to a shape of said contact inserted therein.

19. The electrical connector as recited in claim 18, wherein said housing has a mating surface facing the second electronic component, said mating surface having a recessed area, said aperture located within said recessed area.

20. An electrical contact for connecting two printed circuit members to each other, the electrical contact comprising:

a mounting portion for connecting the contact to a first one of the printed circuit members; and a mating portion connected to the mounting portion, the mating portion being adapted to contact a second one of the printed circuit members and being sized and shaped to deflect towards the mounting portion when moved by the second printed circuit member, wherein the mating portion has two spaced ends and a contact area for contacting the second printed circuit member which is between the two spaced ends and located further away from the mounting portion than the two spaced ends, wherein the mating portion is sized and shaped to wipe a contact wipe path along the second printed circuit member as the mating portion is moved by the second printed circuit member, and wherein the contact wipe path has a general arced shape.

21. A contact as in claim 20 wherein the mating portion is sized and shaped to wipe two arced contact paths along the second printed circuit member.

22. A contact as in claim 21 wherein the two paths are substantially mirror images of each other.

23. A contact as in claim 20 wherein the mating portion is sized and shaped to twist at a point of contact with the second printed circuit member.

* * * * *